United States Patent [19]

Tyler

[11] Patent Number: 4,947,659

[45] Date of Patent: Aug. 14, 1990

[54] FABRIC SEVERING DEVICE FOR CIRCULAR KNITTING MACHINE

[75] Inventor: Thomas W. Tyler, Davidson County, N.C.

[73] Assignee: Adele Knits, Winston-Salem, N.C.

[21] Appl. No.: 335,421

[22] Filed: Apr. 10, 1989

[51] Int. Cl.[5] ..... D04B 35/10; D04B 1/00

[52] U.S. Cl. ..... 66/147; 112/262.2

[58] Field of Search ..... 66/147; 112/262.2; 139/291 C

[56] References Cited

U.S. PATENT DOCUMENTS

| | | | |
|---|---|---|---|
| 2,017,082 | 10/1935 | Warren . | |
| 3,209,559 | 10/1965 | Sharp et al. . | |
| 3,855,822 | 12/1974 | Lee . | |
| 3,998,249 | 12/1976 | Pfarrwaller | 139/291 C |
| 4,157,651 | 6/1979 | Coggins et al. . | |
| 4,454,730 | 6/1984 | Gregory et al. . | |
| 4,538,534 | 9/1985 | Frazier et al. | 112/262.2 |

FOREIGN PATENT DOCUMENTS

| | | | |
|---|---|---|---|
| 2303099 | 8/1973 | Fed. Rep. of Germany | 66/147 |
| 1596603 | 7/1970 | France | 66/147 |
| 197802 | 8/1976 | Netherlands | 353/66 |
| 988607 | 4/1965 | United Kingdom | 66/147 |

OTHER PUBLICATIONS

Textile Institute and Industry–F. Strasser, vol. 8, No. 12, 12/70, Some Conventional and Unconventional Methods . . . pp. 337–340.

*Primary Examiner*—Werner H. Schroeder
*Assistant Examiner*—John J. Calvert
*Attorney, Agent, or Firm*—Bell, Seltzer, Park & Gibson

[57] ABSTRACT

The fabric is withdrawn from the needle cylinder of the knitting machine and is flattened so that the present fabric severing device can periodically sever a predetermined length of the fabric in a transverse direction while the fabric is being produced by the knitting machine. The fabirc severing device includes a hot wire positioned below fabric tensioning rolls of the knitting machine. The hot wire is normally maintained out of the path of travel of the flattened fabric and horizontal movement is applied to the hot wire to move the hot wire against and through the flattened fabric and thereby transversely sever a length of the fabric. A pneumatic transport system is provided for removing the severed length of fabric from a position beneath the hot wire cutting device and transporting the severed length of fabric to a location spaced from the knitting machine.

8 Claims, 4 Drawing Sheets

FABRIC SEVERING DEVICE FOR CIRCULAR KNITTING MACHINE

FIELD OF THE INVENTION

This invention relates generally to a fabric severing device for a circular knitting machine, and more particularly to such a device which operates periodically to sever a predetermined length of the flattened fabric in a transverse direction as the knit fabric is being produced by the knitting machine.

BACKGROUND OF THE INVENTION

When producing knit wiping cloths and the like, it is the usual practice to wind up the circular knit fabric in a flattened condition on a take-up roll which rotates with the needle cylinder. The roll of knit fabric is then removed from the knitting machine and laid up in multiple layers along a cutting table. The stacked layers of flattened tubular knit fabric are then transversely cut by a fabric cutting saw or knife into predetermined lengths to produce stacks of wiping cloths. It is desirable to cut each of the wiping cloths with the same number of knit courses therein. However, it is difficult to lay up each layer of the knit fabric on the cutting table under uniformly tensioned conditions, so that some layers of fabric may be stretched longitudinally to a greater extent than others. Under these circumstances, the wiping cloths may have different numbers of courses therein, even though the stacked layers of knit fabric are cut of exactly the same length.

Also, transverse cutting of the knit fabric with a cutting saw or knife leaves short loose ends of yarn formed by partial stitch loops. These small loose ends of yarn are difficult to remove during subsequent washing and finishing operations. If the wiping cloth is used in dust and lint removal prior to painting, these short loose ends of yarn can become dislodged and be deposited on the article which is being cleaned by the wiping cloth. This known system of producing cut lengths of knit fabric, such as wiping cloths, is expensive since it requires that the knitting machine remain idle while the roll of knit cloth is removed. It takes expensive equipment and time to lay up the layers of knit fabric and to then cut the layers of knit into predetermined lengths.

SUMMARY OF THE INVENTION

In contrast to the above, the present invention provides a fabric severing device which is attached to the circular knitting machine and operates to periodically sever a predetermined length of the knit fabric in a transverse direction while the fabric is being produced by the knitting machine. The present severing device operates after a predetermined number of revolutions of the needle cylinder, thereby insuring that each severed length of the knit fabric contains the same number of courses. A hot wire cutter is employed in the present fabric severing device so that the severed stitch loops are fused and the short ends of yarn do not easily become dislodged. Cutting the knit fabric into the proper lengths while it is being produced on the knitting machine thus eliminates the expensive steps of unrolling, laying up, and cutting of the stacked layers of flattened tubular fabric, as has heretofore been required.

The fabric severing device of the present invention is mounted on a conventional circular knitting machine including a rotatable needle cylinder with a frame extending beneath the needle cylinder and rotatable therewith. Fabric tensioning rolls are supported on the frame and rotate in timed relationship to rotation of the needle cylinder to withdraw the knit fabric in a flattened condition as the fabric is produced by the knitting machine. The present fabric severing device is supported on the rotating frame, which usually supports a take-up roll, and operates to periodically sever a predetermined length of the fabric in a transverse direction while the fabric extends downwardly from the fabric tensioning rolls. The fabric severing device includes a hot wire positioned below the fabric tensioning rolls and supported by the frame in a position extending transversely of and normally out of the path of travel of the flattened fabric as it extends downwardly from the fabric tensioning rolls.

After a predetermined number of courses have been knit, the severing device operates to move the hot wire inwardly and across the path of travel of the flattened fabric, thereby transversely severing a length of the fabric. It is preferred that the fabric be knit, at least in part, of thermoplastic yarn so that the hot wire will sever and melt the edge of the fabric to fuse the cut ends of any stitch loop yarns and prevent these free ends of loose yarn from being dislodged from the wiping cloth.

As each successive length of the knit fabric is severed, the cut length of fabric is deposited in a collection chute or trough which rotates with the hot wire. The collection trough is connected to one end of a pneumatic tube system for removing the severed lengths of knit fabric from the bottom of the collection trough and transporting the severed lengths of knit fabric to a location spaced from the knitting machine where they are deposited in a suitable collection receptacle.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
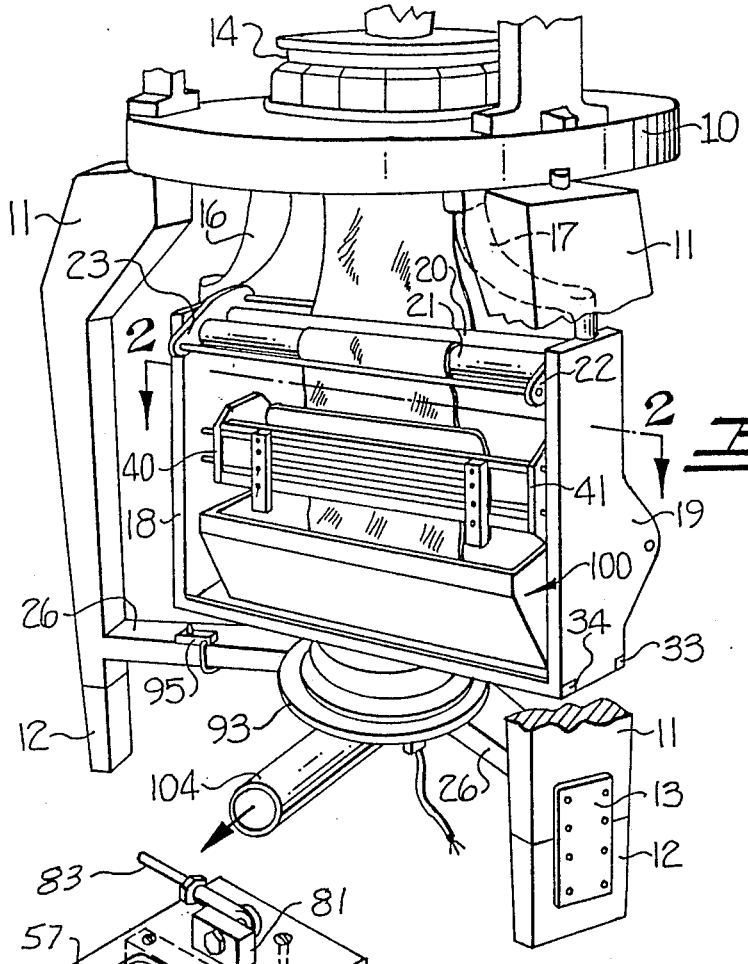
FIG. 1 is a fragmentary perspective view of a conventional type of circular knitting machine and showing the present fabric severing device applied thereto.
Figure 5:
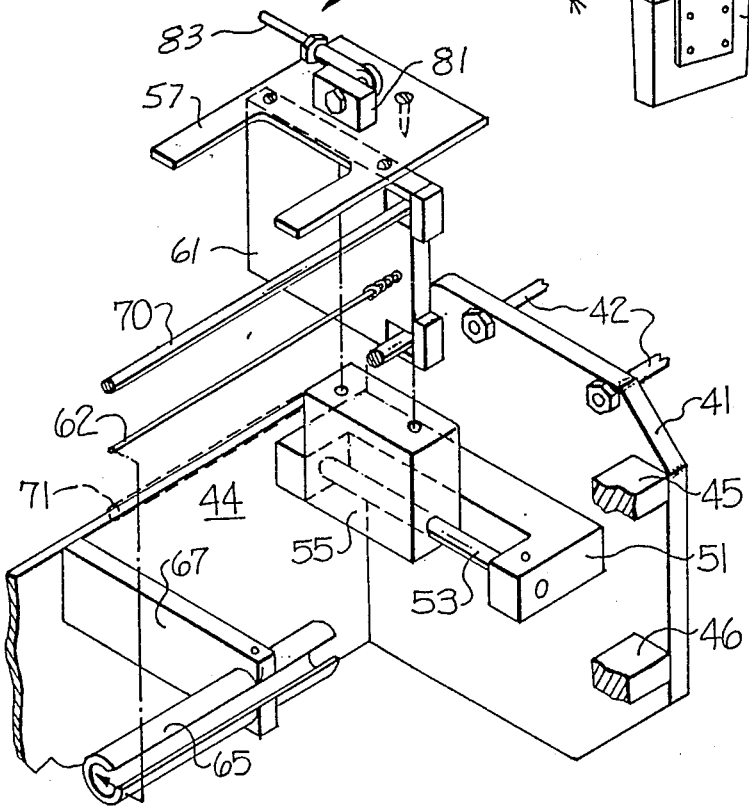
FIG. 5 is an exploded isometric view of a portion of the fabric severing device, looking in the direction of the arrow 5 in FIG. 3.

The fabric severing device of the present invention is illustrated in FIG. 1 as being mounted on a conventional type of circular knitting machine including a circular bed plate 10 supported on the upper ends of spaced-apart legs 11. Only two of the legs 11 are shown in FIG. 1 and the machine is normally supplied with a third leg on the back side, not shown. In order to accommodate the fabric severing device of the present invention, it is necessary to raise the normal level of the knitting machine and this is accomplished by adding leg extenders 12 thereto. The leg extenders 12 are held in position below the lower ends of the legs 11 by support plates 13. A conventional needle cylinder 14 is supported for rotation in the bed plate 10. A frame extends beneath the needle cylinder 14 and is rotatable therewith and includes a pair of support brackets 16, 17, the upper ends of which are fixed on the rotatable needle cylinder 14 and the lower ends of which support the upper ends of respective side frame members 18, 19.

Conventional fabric tensioning rolls 20, 21 (FIG. 3) are supported at opposite ends on rocker brackets 22, 23, pivotally supported between the upper portions of the respective side frame members 18, 19. The lower end portions of the legs 11 are connected together by spider arms 26 which extend inwardly from the legs 11 and support a stationary take-up drive gear 30 on a support hub 29. A circular gear cover housing 31 (FIG. 3) surrounds the stationary drive gear 30 and is supported for rotation thereon by a ball bearing 32. The rotating gear cover housing 31 is fixed to the lower end portions of the side frame members 18, 19 by spaced-apart support bars 33, 34, the opposite ends of which are fixed to the lower ends of the side frames 18, 19 (FIG. 1).

Figure 4:
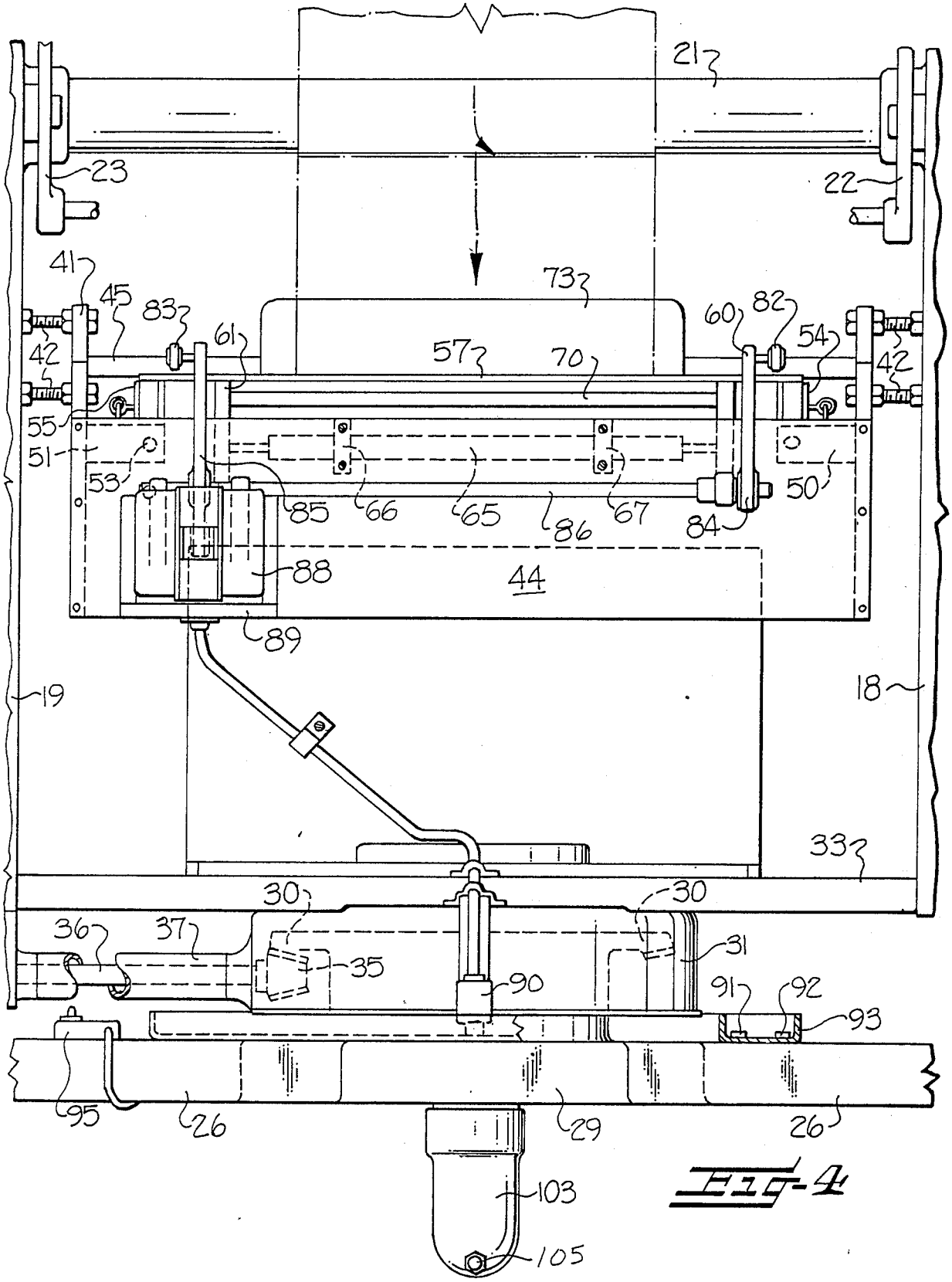
FIG. 4 is a fragmentary elevational view looking inwardly at the left-hand side of FIG. 3.

As illustrated in FIG. 4, a drive pinion 35 is positioned in engagement with the stationary take-up drive gear 30 and is fixed on one end of a drive shaft 36. The drive shaft 36 is supported for rotation in a tubular housing 37 connected between the gear cover housing 31 and the side frame member 19. A conventional gear and chain drive, not shown, operatively connects the drive shaft 36 to the fabric tensioning rolls 20, 21, to rotate the same in timed relationship with rotation of the needle cylinder 14 and the frame supported by and extending beneath the needle cylinder.

The parts heretofore described are conventional parts of a typical circular knitting machine. This conventional type of circular knitting machine is normally provided with a fabric take-up roll mechanism supported between the lower ends of the side frame members 18, 19 for winding the flattened fabric into a roll as it is produced by the knitting machine. When the roll has reached the maximum capacity, the machine must be stopped, and the roll removed and replaced with an empty shaft or core upon which the next roll of knit fabric will be wound. In accordance with the present invention, the usual take-up roll mechanism has been eliminated while the fabric tension rolls 20, 21 have been retained and the removed take-up roll mechanism is replaced with the present fabric severing device.

Figure 3:
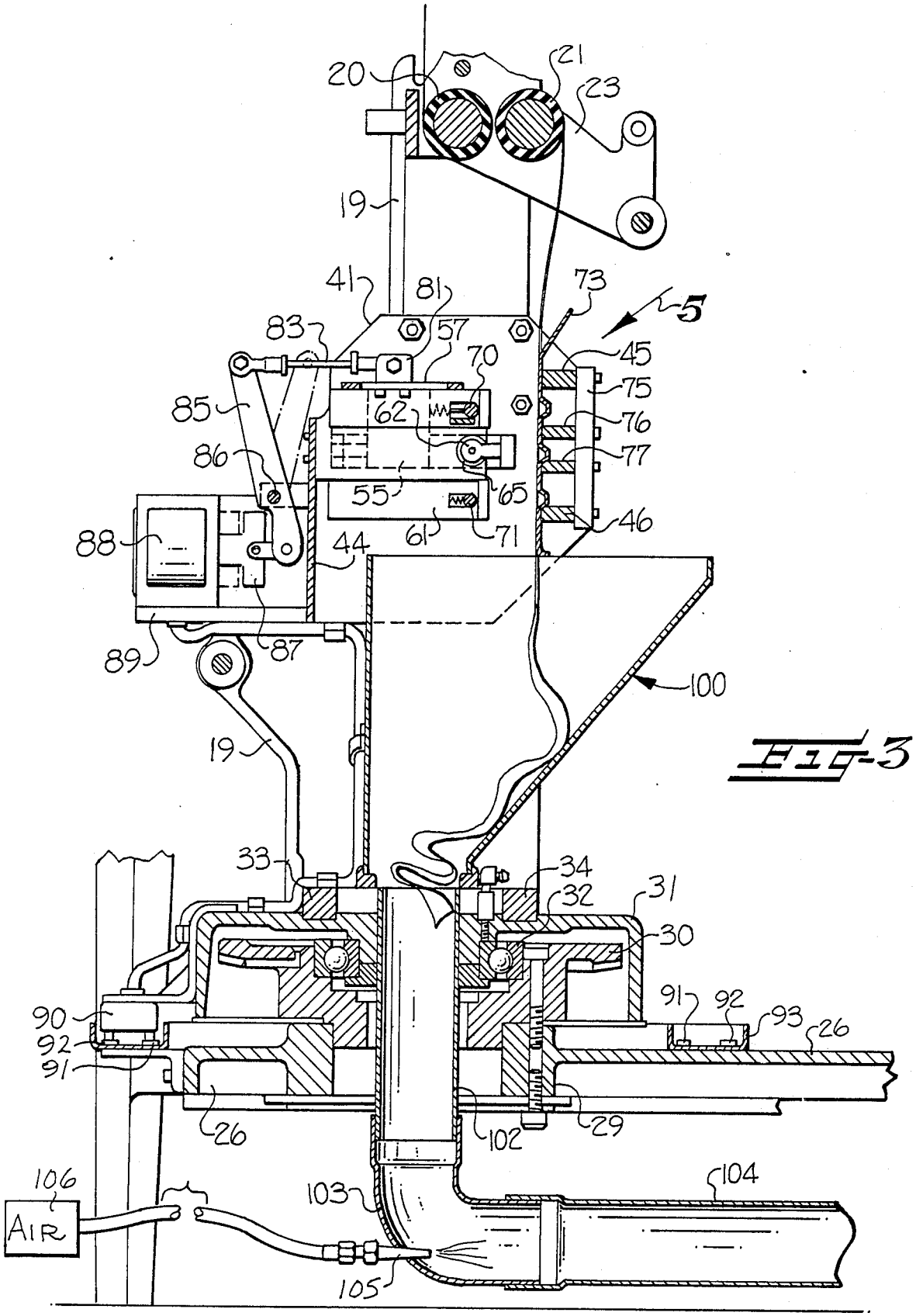
FIG. 3 is a vertical sectional view taken substantially along the line 3—3 in FIG. 2.

The present fabric severing device includes means for periodically severing a predetermined length of the fabric in a transverse direction while the fabric extends downwardly from the fabric tensioning rolls 20, 21, as illustrated in FIG. 3. The fabric severing device includes spaced-apart end wall members or plates 40, 41 positioned adjacent the respective side frame members 18, 19 and maintained in adjusted position therebetween by threaded studs 42 (FIG. 4). The end wall plates 40, 41 are maintained in spacedapart fixed relationship by a horizontally disposed support plate 44 having opposite end portions fixed on one edge of the end wall plates 40, 41. Upper and lower horizontal support bars 45, 46 are fixed at opposite ends to the other edge of the end wall plates 40, 41.

Figure 2:
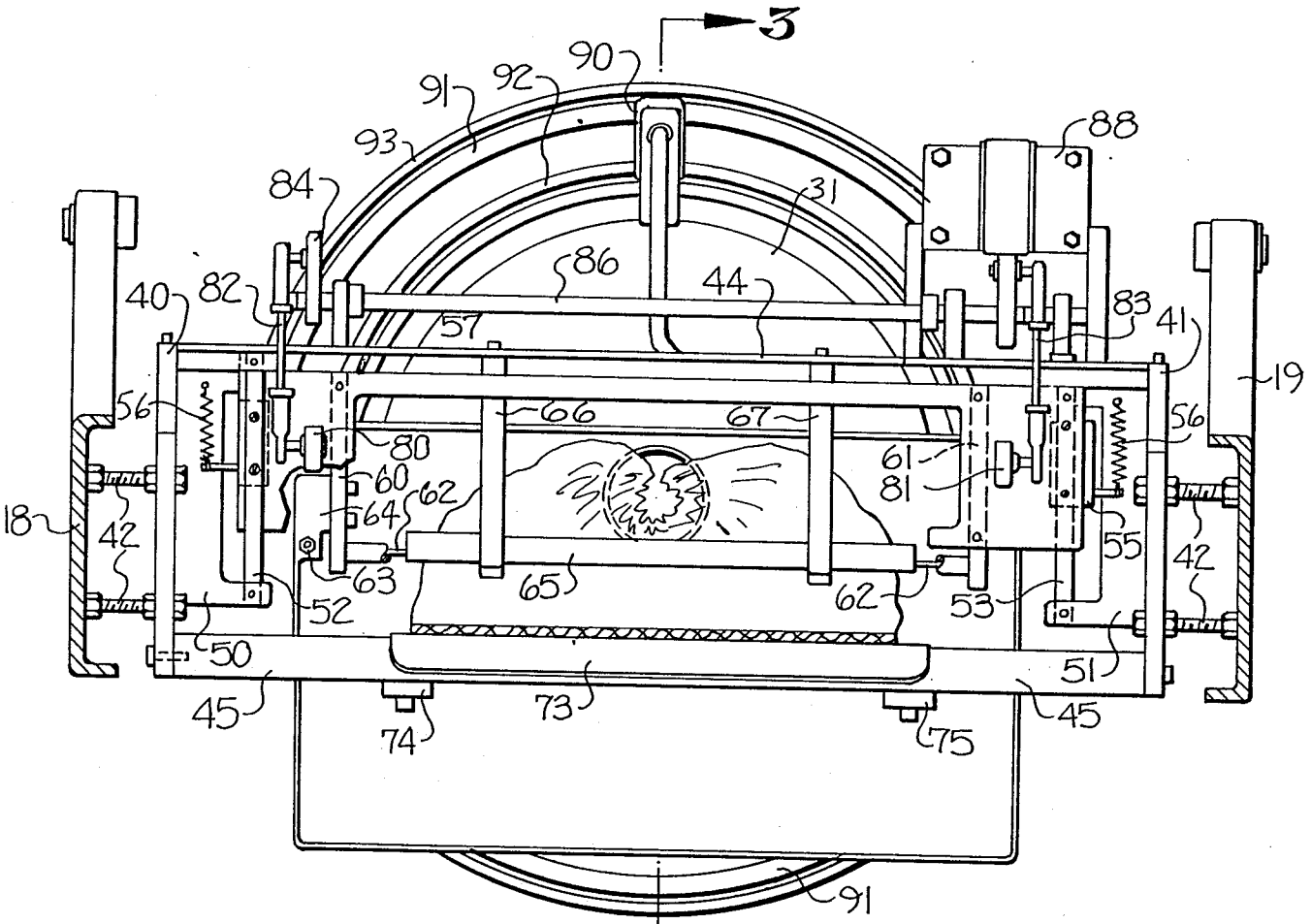
FIG. 2 is an enlarged horizontal sectional view taken substantially along the line 2—2 in FIG. 1.

C-shaped support brackets 50, 51 are fixed to the inner surfaces of the respective end wall plates 40, 41 (FIG. 2) and have spaced-apart legs extending inwardly therefrom. The inner ends of the legs of the C-shaped support brackets 50, 51 support opposite ends of respective slide rods 52, 53 on which the lower ends of respective vertically extending slide brackets 54, 55 are supported for forward and rearward sliding movement. The slide brackets 54, 55 are normally urged rearwardly along the slide rods 52, 53 by tension springs 56, as shown in FIG. 2. A horizontally extending upper support plate 57 is fixed at opposite ends to the upper ends of the slide brackets 54, 55 (FIG. 2). As illustrated in FIG. 2, the central portion of the horizontal upper support plate 57 is cut away, to reduce the weight thereof and to also permit some flexibility when the horizontal support plate 57 is moved back and forth along the slide rods 52, 53, in a manner to be presently described.

Spaced-apart vertically extending support plates 60, 61 are fixed at their upper ends on opposite end portions of the horizontal support plate 57 and extend downwardly therefrom. One end of a high resistance electrical conductor wire (a hot wire) 62 is supported for adjustment on an adjustment stud 63 (FIG. 2) carried by a bracket 64 which is fixed to the outer surface of the vertical support plate 60. The opposite end of the hot wire 62 is fixed in the vertical support plate 61. The hot wire 62 is normally covered by a C-shaped shield 65 (FIG. 2) which is supported in the forward free ends of spaced-apart support plates 66, 67 (FIG. 2), the opposite ends of which are fixed on the vertical support plate 44. Spaced above and below the hot wire 62 are respective upper and lower pressure applying rods 70, 71 (FIG. 3) which are supported at opposite ends in the vertically extending support plates 60, 61. Opposite ends of the rods 70, 71 are supported for resilient inward movement in slotted openings in the support plates 60, 61.

The medial portions of the support bars 45, 46 support a fabric guide plate 73 which extends in a vertical direction for guiding the fabric as it moves downwardly from the upper tension roll 21 (FIG. 3). Spaced-apart vertical spacer bars 74, 75 are fixed at their upper and lower ends to the horizontal support bars 45, 46 and have opposite ends of horizontal spacer bars 76, 77 fixed thereto (FIG. 3). The fabric guide plate 73 is provided with horizontally extending inwardly bent passageways or grooves over which the fabric normally passes as it is being knit and extends downwardly thereby. The upper and lower grooves accommodate the tension bars 70, 71 while the middle groove is provided to permit the hot wire 62 to pass through the fabric, when the hot wire 62 is moved against the fabric, in a manner to be presently described.

Operator means is provided for imparting horizontal movement to the hot wire 62 and the support means therefore to move the hot wire 62 against and through the fabric to thereby transversely sever a length of the fabric. The operator means includes upstanding pusher plates 80, 81, having their lower ends fixed on the horizontal support plate 57, and being operatively connected to the forward ends of corresponding operator links 82, 83. The rear ends of the links 82, 83 are connected to the upper ends of respective operating levers 84, 85 (FIG. 4). The lower end of the lever 84 is fixed on one end of a rock shaft 86 suitably supported adjacent opposite ends in support brackets carried by the vertical support plate 44. The lever 85 extends downwardly below the rock shaft 86 (FIG. 3) and its lower end is connected to solenoid means, including an armature 87 and an electromagnet 88. The electromagnet 88 is fixed on a shelf plate 89, carried by the vertical support plate 44.

Electricity is supplied to the electromagnet 88 and the hot wire 62 by means of suitable electrical connectors extending downwardly from a contact shoe 90

(FIG. 3) suitably supported on the rotatable gear cover housing 30. The connectors of the contact shoe 90 ride on electrified tracks 91, 92 supported in the lower surface of a U-shaped circular trackway 93 which is fixed on the spider arms 26 and surrounds the gear cover housing 31. A rotation detecting sensor, such as a transducer 95, is supported in a fixed position, as illustrated on the spider arm 26 (FIGS. 1 and 4), to detect the number of revolutions of the frame supporting the fabric severing device of the present invention. The sensor 95 can be connected to a suitable control to operate the solenoid 88 after a predetermined number of courses have been knit to thereby move the hot wire 62 transversely and sever the flattened knit fabric passing over the guide plate 73.

As the cut length of flattened knit fabric extends downwardly, it falls into a collection chute or trough, broadly indicated at 100, and supported between the side frame members 18, 19. The lower free end of the knit fabric will normally engage the inwardly slanted forward wall of the trough 100 before the knit fabric is severed by the hot wire 62, as illustrated in FIG. 3. The free end will be positioned adjacent and across the upper end of a vertically extending stationary plastic conduit 102. The plastic conduit 102 extends downwardly through the rotating gear cover housing 31 and the stationary take-up drive gear 30. The lower end of the plastic conduit 102 is connected to an elbow 103 and to a horizontally extending plastic conduit 104. An air jet nozzle 105 is supported in the elbow 103 and is connected to a source of compressed air, as indicated at 106 in FIG. 3.

The trough 100 and the plastic conduits 102–104 form a part of a pneumatic transport system which is operable for removing the severed length of knit fabric from a position beneath the hot wire cutting device 62 and for transporting the severed length of knit fabric to a location spaced from the knitting machine, such as a collection bin or the like. The severed lengths of wiping cloth may be deposited directly into a dye bag positioned in a collection container, not shown, so that they can be placed in a finishing machine, such as a washer or the like, without requiring further handling.

As the knit fabric is produced by the knitting machine, it passes through the tensioning rolls 20, 21 (FIG. 3), in front of the fabric guide plate 73, and into the collection trough 100. The sensor 95 counts the number of revolutions of the needle cylinder (number of courses knit) and operates the solenoid 88, after the desired number of courses have been knit by the machine. Operation of the solenoid 88 causes the hot wire 62, and the pressure applying rods 70, 71, to move forwardly so that the hot wire 62 passes through the flattened knit fabric to sever the same. The air jet nozzle 105 then forces compressed air through the conduit 104, creating a suction in the lower end of the collection trough 100, and drawing the cut length of knit fabric through the conduits 102–104 and depositing the same in a suitable collection container.

The present fabric severing device thus operates to periodically sever a predetermined length of flattened knit fabric while the fabric is being continuously produced by the circular knitting machine. The length of knit fabric severed by the present device can be varied as desired and can be repeatedly cut into suitable tubular fabric lengths for use as wiping cloths and the like. Because the end of the fabric is severed by a hot wire, the cut ends of the knit fabric, particularly if formed at least in part of thermoplastic yarn, will be melted and fused together to prevent loose ends of yarn from being accidentally displaced or dislodged from the wiping cloth. Each wiping cloth produced by the knitting machine is thus of the same length and contains the same number of courses so that all of the wiping cloths produced are of the same size.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular knitting machine including a rotatable needle cylinder, a frame extending beneath said needle cylinder and rotatable therewith, fabric tensioning roll means supported on said frame and rotatable in timed relationship to rotation of said needle cylinder to withdraw the knit fabric in a flattened condition as the fabric is produced by the knitting machine, the combination therewith of means for periodically severing a predetermined length of the fabric in a transverse direction while the fabric extends downwardly from said fabric tensioning roll means, said fabric severing means including a hot wire positioned below said fabric tensioning roll means, support means carried by said frame for engaging opposite end portions of said hot wire to normally maintain said hot wire extending transversely of and out of the path of travel of the flattened fabric extending downwardly from said fabric tensioning roll means, operator means for imparting horizontal movement to said hot wire support means and to move said hot wire against and through the fabric to thereby transversely sever a length of the fabric, wherein said operator means includes solenoid means operatively connected to said hot wire for moving the same against and through the knit fabric, and upper and lower pressure applying rods positioned above and below said hot wire, said pressure applying rods being resiliently supported at opposite ends and being engageable with the fabric when said hot wire moves against and through the knit fabric.

2. In a circular knitting machine according to claim 1 including control means operable in response to the knitting of a predetermined number of courses of the fabric, said control means being operatively associated with said operator means to move said hot wire against and through the fabric after a predetermined number of courses have been knit.

3. In a circular knitting machine according to claim 1 including pneumatic transport means operable for removing the severed length of fabric from a position beneath said hot wire and transporting the severed length of fabric to a collection location spaced from said knitting machine.

4. In a circular knitting machine according to claim 3 wherein said pneumatic transport means includes a through supported by said frame and positioned beneath said hot wire for receiving a severed length of the fabric, and conduit means operatively connected at one end to said through and having its other end positioned at the collection location spaced from said knitting machine.

5. In a circular knitting machine including a rotatable needle cylinder, a frame extending beneath said needle cylinder and rotatable therewith, fabric tensioning roll means supported on said frame and rotatable in timed relationship to rotation of said needle cylinder to withdraw the knit fabric in a flattened condition as the fabric is produced by the knitting machine, the combination therewith of means for periodically severing a predetermined length of the fabric in a transverse direction while the fabric extends downwardly from said fabric tensioning roll means, said fabric severing means including a hot wire positioned below said fabric tensioning roll means, support means carried by said frame for engaging opposite end portions of said hot wire to normally maintain said hot wire extending transversely of and out of the path of travel of the flattened fabric extending downwardly from said fabric tensioning roll means, said support means including spaced-apart support plates supporting opposite end portions of said hot wire, a horizontal support plate on which said spaced-apart support plates are mounted, and means supporting said horizontal support plate on said frame for horizontal sliding movement toward and away from the path of travel of the flattened fabric extending downwardly from said fabric tensioning roll means, operator means for imparting horizontal movement to said hot wire support means and to move said hot wire against and through the fabric to thereby transversely sever a length of the fabric, control means operable in response to the knitting of a predetermined number of courses of the fabric, said control means being operatively associated with said operator means to move said hot wire against and through the fabric after a predetermined number of courses have been kit, and pneumatic transport means operable for removing the severed length of fabric from a position beneath said hot wire and transporting the severed length of fabric to a location spaced from said knitting machine.

6. In a circular knitting machine according to claim 5 wherein said frame includes spaced-apart side frame members, wherein said support means includes an end wall plate supported adjacent each of said side frame members, a slide rod supported on each of said end wall plates, and a slide bracket supported on opposite end portions of said horizontal support plate and being supported for sliding movement on said slide rods.

7. In a circular knitting machine according to claim 6 including resilient means connected to said slide blocks and being operable to resiliently urge said horizontal support plate away from the path of travel of the flattened fabric extending downwardly from said fabric tensioning roll means.

8. In a circular knitting machine according to claim 7 wherein said operator means is operatively connected to said horizontal support plate for moving said hot wire against and through the flattened knit fabric.

* * * * *